United States Patent [19]

Brokloff et al.

[11] Patent Number: 4,969,501

[45] Date of Patent: Nov. 13, 1990

[54] METHOD AND APPARATUS FOR USE DURING CASTING

[75] Inventors: John E. Brokloff, North Canton; Richard C. Kerr, Salineville; Thomas L. Betz, North Canton, all of Ohio

[73] Assignee: PCC Airfoils, Inc., Cleveland, Ohio

[21] Appl. No.: 433,766

[22] Filed: Nov. 9, 1989

[51] Int. Cl.[5] ..... B22D 27/04

[52] U.S. Cl. ..... 164/122.1; 164/338.1

[58] Field of Search ..... 164/122.1, 122.2, 369, 164/338.1

[56] References Cited

U.S. PATENT DOCUMENTS

| | | | |
|---|---|---|---|
| 3,714,977 | 2/1973 | Terkelsen . | |
| 4,673,021 | 6/1987 | Graham et al. . | |
| 4,712,604 | 12/1987 | Sawyer . | |
| 4,757,856 | 7/1988 | George . | |
| 4,763,716 | 8/1988 | Graham et al. | 164/122.1 |
| 4,819,709 | 4/1989 | Lallement . | |

*Primary Examiner*—Kuang Y. Lin

*Attorney, Agent, or Firm*—Tarolli, Sundheim & Covell

[57] ABSTRACT

A baffle retard the transfer of heat from a mold structure to a chill plate during casting of molten metal. The baffle includes a circular support portion and a plurality of flexible segments which extend from the support portion. Each of the segments is engageable with an irregular side portion of the mold structure. During a casting operation, the chill plate and mold structure are lowered from a furnace chamber. As they are lowered, the baffle is maintained in engagement with an irregular side portion of the mold structure until the irregular side portion moves below the baffle. To maintain the baffle in engagement with the irregular side portion of the mold structure during lowering of the mold structure, the flexible segments of the baffle resiliently flex toward and away from the central axis of the baffle. The flexible segments of the baffle may advantageously be formed of a graphite foil.

19 Claims, 6 Drawing Sheets

METHOD AND APPARATUS FOR USE DURING CASTING

BACKGROUND OF THE INVENTION

The present invention relates to a method and apparatus for use during the casting of metal and more specifically to a baffle which retards the transfer of heat from a mold structure.

An apparatus which uses inner and outer baffles to retard the transfer of heat from a mold structure to a chill plate during the casting of molten metal in the mold structure is disclosed in U.S. Pat. No. 4,763,716 issued Aug. 16, 1988 and entitled "Apparatus and Method for Use in Casting Articles". The annular outer baffle has a circular inner edge portion which cooperates with an irregular outer side portion of the mold structure to block the transfer of heat from the furnace chamber. Similarly, the inner baffle has a circular outer edge portion which cooperates with an irregular inner side portion of the mold structure to block the transfer of heat. Due to the circular configurations of the baffles and the irregular configurations of the side portions of the mold structure, there will be some space between the edge portions of the baffles and the irregular side portions of the mold structure. This space is to accommodate both the irregular configuration of the side portions of the mold structure and any irregularities which occur during forming of the mold structure.

During a casting operation which calls for directional solidification of molten metal in a mold structure, it is advantageous to have a temperature gradient which is as large as possible across a baffle. The presence of a relatively large temperature gradient across the baffle results in the portion of the mold structure above the baffle being relatively hot and the portion of the mold structure below the baffle being relatively cool. This promotes solidification of the molten metal upwardly from the lower end portion of an article mold cavity. In addition, the establishment of a relatively large temperature gradient between portions of the mold structure disposed above and below the baffle tends to promote the solidification of the molten metal with a fine dendritic structure.

It has been suggested that a baffle could be constructed with a graphite felt layer extending from a pair of support discs toward an irregular side portion of a mold structure. The felt layer is cut to a configuration corresponding to the configuration of a lower end portion of the mold structure. This enables the felt layer to engage the the lower end portion of the mold structure when the mold structure is disposed in a furnace chamber.

As the mold structure is withdrawn from the furnace chamber, the felt layer of this known baffle cannot maintain engagement with the irregular side portion of the mold structure. This results in the opening of space between the felt layer and the mold structure. Of course, heat can be freely transferred through the space between the belt layer and mold structure. This transfer of heat is detrimental to the establishing of a large temperature gradient across the baffle. A baffle having this construction is disclosed in U.S. Pat. No. 3,714,977 issued Feb. 6, 1973 and entitled "Method and Apparatus for the Production of Directionally Solidified Castings."

SUMMARY OF THE INVENTION

The present invention is directed to a method and apparatus which is used during the casting of molten metal in a mold structure having an irregular side portion. The apparatus includes a movable chill plate which supports the mold structure in a furnace chamber. A baffle is provided to retard the transfer of heat from the mold structure when the mold structure is in the furnace chamber and during withdrawal of the mold structure from the furnace chamber.

The baffle includes a support portion and a plurality of flexible segments which extend from the support portion. End portions of at least some of the flexible segments are engageable with and movable relative to the irregular side portion of the mold structure during relative movement between the baffle and the mold structure. The flexible characteristics of the segments enable them to remain in engagement with the irregular side portion of the mold structure until the irregular side portion moves below the baffle as the mold structure is lowered from the furnace chamber.

Accordingly, it is an object of this invention to provide a new and improved method and apparatus for use during the casting of molten metal in a mold structure having an irregular side portion and wherein a baffle has a plurality of flexible segments which are movable relative to the irregular side portion of the mold structure to enable end portions of at least some of the segments to engage the irregular side portion of the mold structure during relative movement between the baffle and the mold structure.

Another object of this invention is to provide a new and improved method and apparatus for use during casting and wherein a baffle is maintained in engagement with an irregular side portion of a mold structure until the side portion of the mold structure moves below the baffle during lowering of the mold structure.

BRIEF DESCRIPTION OF THE DRAWINGS

The foregoing and other objects and features of the invention will become more apparent upon a consideration of the following description taken in connection with the accompanying drawings, wherein.

DESCRIPTION OF SPECIFIC PREFERRED EMBODIMENTS OF THE INVENTION

General Description—Apparatus

Figure 1:
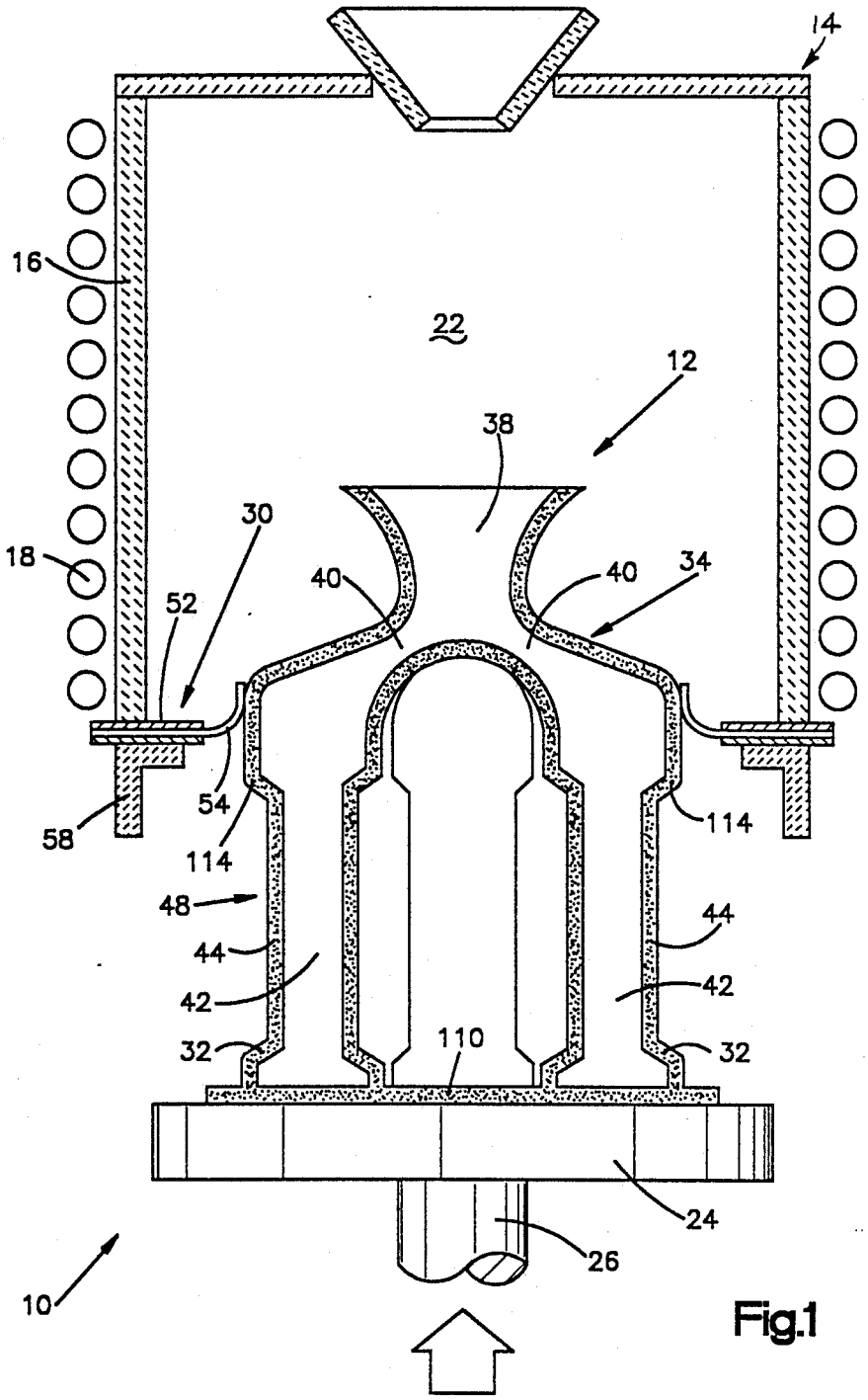
FIG. 1 is a schematic illustration depicting the relationship between a baffle and a mold structure as the mold structure is moved into a furnace.

An apparatus 10 for use during the casting of molten metal in a mold structure 12 is illustrated in FIG. 1. The apparatus 10 includes an induction furnace 14 having a cylindrical graphite susceptor wall 16 enclosed by a helical induction coil 18. When the coil 18 is energized, heat is transmitted to a cylindrical furnace chamber 22 in a known manner.

The mold structure 12 is supported on a circular water cooled copper chill plate 24. The chill plate 24 is movable vertically relative to the furnace 14 by a drive assembly (not shown) connected with a vertical cylindrical post 26 which supports the chill plate 24. The drive assembly includes a reversible motor which is operable to raise and lower the chill plate 24. Thus, the drive assembly is operable to move the chill plate 24 downwardly away from the furnace 14 to a loading position. When the chill plate 24 is in the loading position, the mold structure 12 can be easily positioned on or removed from the chill plate 24.

The drive assembly can be operated to raise the chill plate 24 and mold structure 12 upwardly from the loading position to a lowered position. When the chill plate 24 and mold structure 12 are in the lowered position, the mold structure 12 is immediately beneath the furnace 14. Continued operation of the drive assembly to raise the chill plate 24 and mold structure 12 moves the mold structure through the position shown in FIG. 1 to the raised position shown in FIG. 2 in which the mold structure 12 is disposed in the furnace chamber 22. The central axes of the cylindrical furnace chamber 14, circular chill plate 24 and cylindrical support post 26 are coincident.

A housing (not shown) encloses the furnace 14 and chill plate 24 during movement of the chill plate between the fully lowered or loading position and the raised position. The housing can be opened to load and unload the mold structure 12 from the chill plate 24. When it is closed, the housing is sealed and can be evacuated. The general construction of the housing and furnace 14 is well known and may be similar to that shown in U.S. Pat. No. 3,841,384 issued Oct. 15, 1974 for "Method and Apparatus for Melting and Casting Metal."

An improved baffle 30 constructed in accordance with the present invention is provided to retard the transfer of heat from the mold structure 12 to the chill plate 24 during a casting operation. The annular baffle 30 is disposed adjacent to the lower end portion 32 (FIG. 2) of the mold structure 12 when the mold structure and chill plate are in their raised positions. At this time, the baffle 30 extends between the susceptor wall 16 and the lower end portion 32 of the mold structure 12 to retard the transfer of heat from the mold structure.

Figure 2:
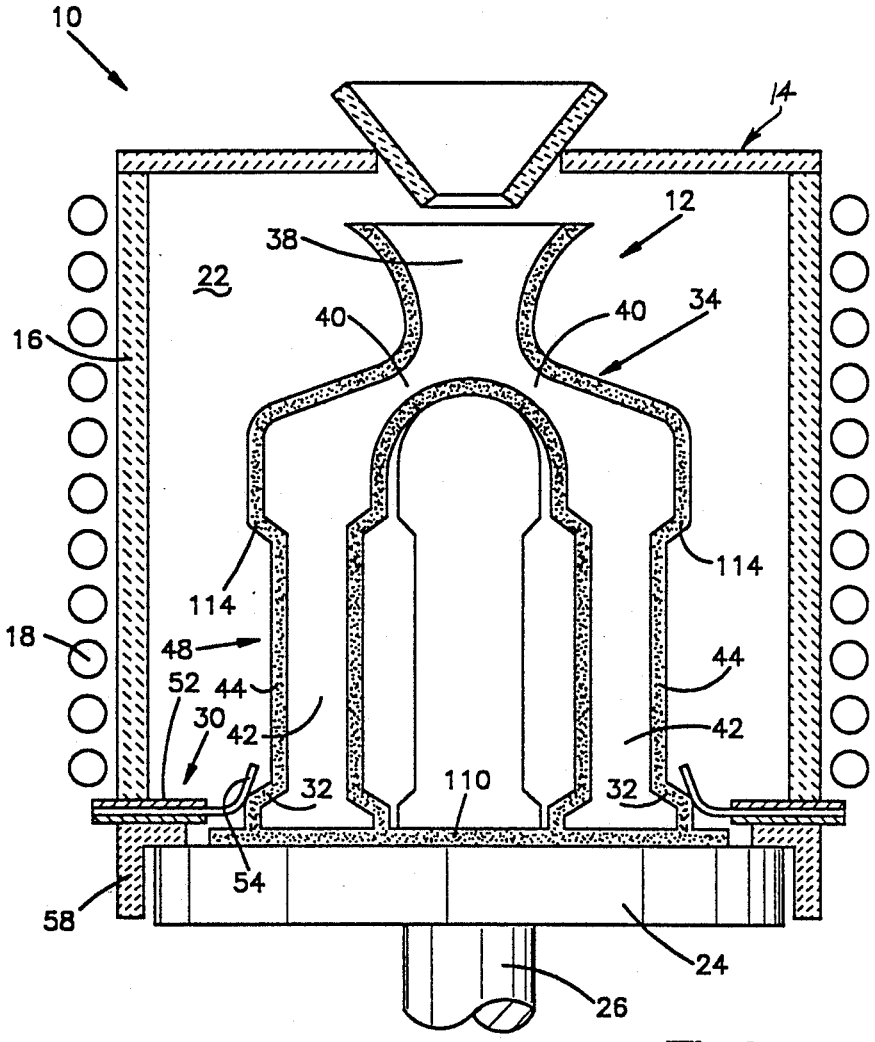
FIG. 2 is a schematic illustration, generally similar to FIG. 1, illustrating the relationship between the baffle and mold structure when the mold structure is disposed in the furnace.
Figure 3:
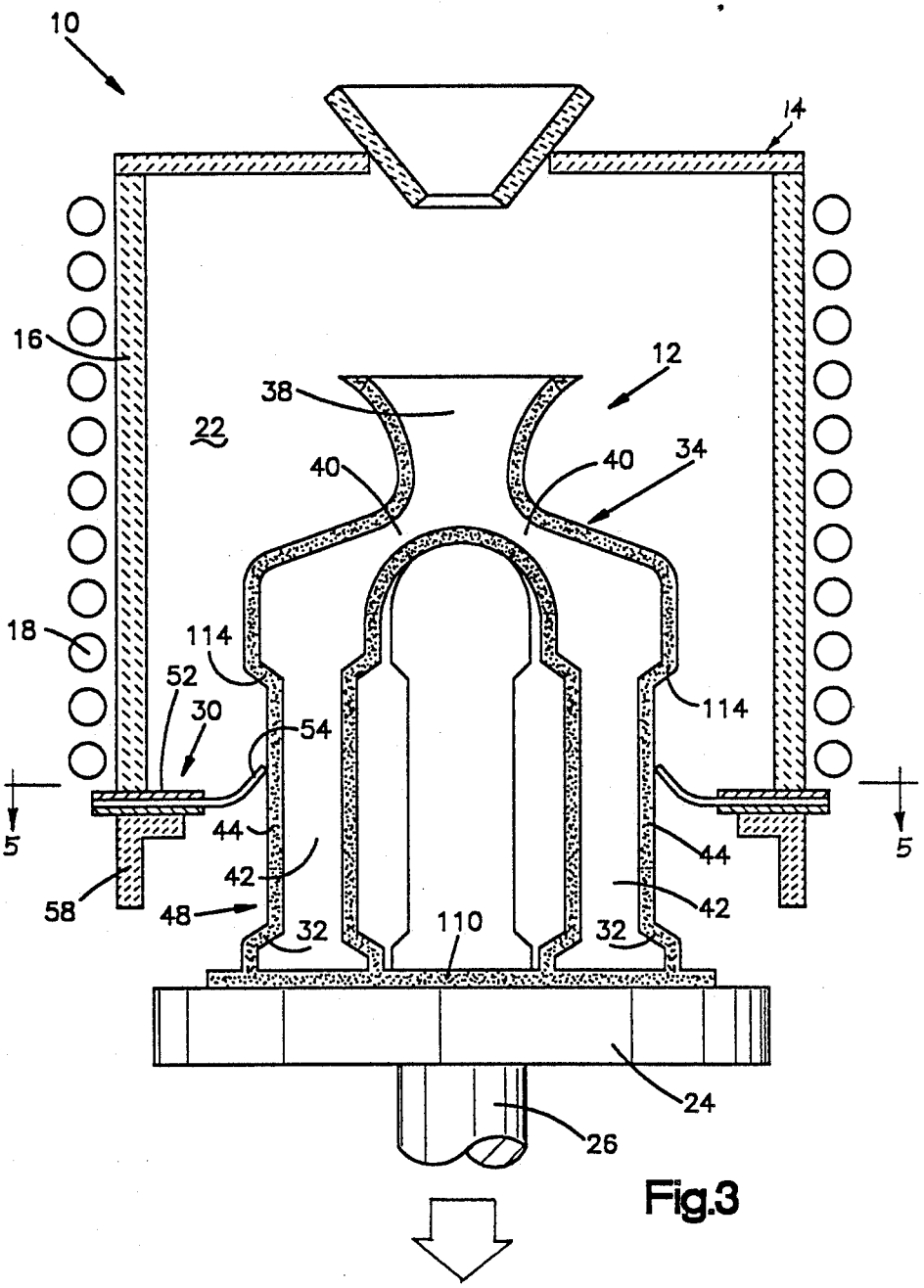
FIG. 3 is a schematic illustration depicting the relationship between the baffle and mold structure as the mold structure is being withdrawn from the furnace.
Figure 4:
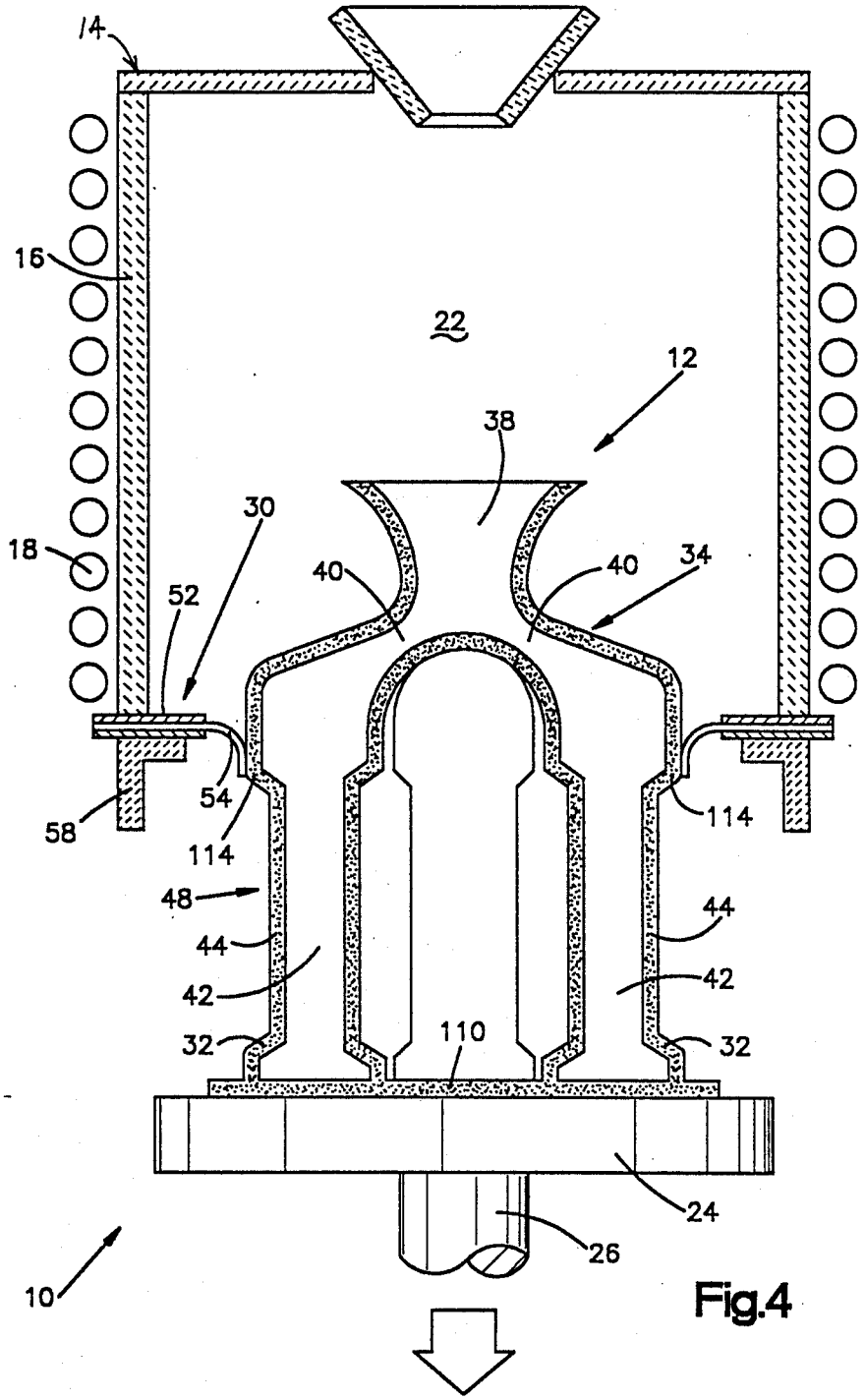
FIG. 4 is a schematic illustration further depicting the relationship between the baffle and mold structure as the mold structure is being withdrawn from the furnace.

As the chill plate 24 and mold structure 12 are lowered from the raised position of FIG. 2 through the positions shown in FIGS. 3 and 4 to a position in which the mold structure is beneath the baffle 30, the baffle retards the transfer of heat from the furnace chamber 22 to the portion of the mold structure 12 which is outside of the furnace chamber. By retarding the transfer of heat between the portions of the mold structure 12 disposed below the baffle 30 and the furnace chamber 22, a relatively large vertical temperature gradient can be established across the baffle.

General Description—Casting

Upon initiation of a casting operation, the mold structure 12 is placed on the chill plate 24 when the chill plate is in the fully lowered or loading position. The chill plate 24 and mold structure 12 are then raised to move the mold structure vertically upwardly from the loading position, through the position shown in FIG. 1, to the raised position shown in FIG. 2. When the mold structure 12 is in the raised position, it is disposed in the furnace chamber 22 and the annular baffle 30 engages the lower end portion 32 of the mold structure.

The housing enclosing the furnace 14 is then sealed and evacuated. The induction coil 18 is energized to preheat the mold structure 12 to a temperature of approximately 2,750° F. During preheating of the mold structure 12, the copper chill plate 24 is cooled by a flow of liquid through the chill plate. The baffle 30 retards the transfer of heat from the hot mold structure 12 and furnace chamber 22 to the relatively cold chill plate 24.

Once the mold structure 12 has been preheated, molten metal is poured into a pour cup 38 disposed in the upper portion 34 of the mold structure 12. Molten metal is conducted from the pour cup 38 through a plurality of runners 40 to article mold cavities 42 disposed in a plurality of article molds 44 (FIGS. 1-5). Although other metals could be used, the articles cast in the molds 42 are formed of a nickel-chrome super alloy.

The specific mold structure 12 illustrated in the drawings has eight article molds (FIG. 5) disposed in an annular array. The upright article molds 44 form a portion of an irregular and upright outer side portion 48 of the mold structure 12. The irregular outer side portion 48 of the mold structure 12 is roughly cylindrical and has a varying cross sectional configuration along the vertical extent of the irregular side portion. The irregular side portion 48 is lacking in perfect symmetry of form and is not straight, smooth or even regular.

The irregular side portion 48 of the mold structure 12 extends upwardly from the lower end of the mold structure and past the lower end of the gating or upper end portion 34 of the mold structure. The vertical extent of the irregular side portion 48 exceeds the vertical extent of the article mold cavities 42 by the extent of starter portions at the bottom of the article mold cavities 42 and a reservoir portion at the upper end portion of the mold cavities. If desired, the mold structure 12 could be constructed so that the vertical extent of the article mold cavities 42 is the same as the vertical extent of the irregular side portion 48.

In the illustrated embodiment of the mold structure 12, there are eight article molds 44 in which turbine blades are to be cast. However, there could be a greater or lesser number of article molds 44 to cast one or more articles other than turbine blades. The orientation of the article molds 44 relative to each other could be changed in order to close or open gaps (see FIG. 5) in the irregular side portion 48 of the mold structure 12.

For example, it is contemplated that the article molds 44 could be rotated in a clockwise (as viewed in FIG. 5) direction about their vertical central axes to close the gaps between the article molds. Of course, if a greater number of article molds 44 were provided in a mold structure having an overall given size, the space between the article molds would be decreased. The vertical extent of the irregular side portion 48 will vary as a function of the length of the turbine blades or other articles to be cast in the molds 44.

After the mold structure 12 has been filled with molten metal, the chill plate 24 and the mold structure are moved slowly downwardly to withdraw the mold structure from the furnace chamber 22. As the mold structure 12 is withdrawn from the furnace chamber 22, the mold structure moves downwardly through a circular opening in the annular baffle 30. The annular baffle 30 cooperates with the irregular side portion 48 of the mold structure to retard the transfer of heat between the furnace chamber 22 and the portion of the mold structure 12 disposed beneath the baffle.

In accordance with a feature of the invention, the baffle 30 is maintained in engagement with the irregular side portion 48 of the mold structure 12 as the chill plate 24 and mold structure are lowered. Thus, as the mold structure 12 and chill plate 24 are lowered from the raised position of FIG. 2 through the positions shown in FIGS. 3 and 4, to a position in which the irregular side portion 48 is just below the baffle 30, engagement is maintained between the baffle and the irregular side portion of the mold structure. This enables the baffle 30 to cooperate with the irregular side portion 48 of the mold structure 12 to retard the transfer of heat from the furnace chamber 22 downwardly past the baffle to the portion of the mold structure 12 below the baffle.

Since the baffle 30 remains in engagement with the irregular side portion 48 of the mold structure 12, a relatively large temperature gradient can be maintained between a portion of the mold structure disposed above the baffle and a portion of the mold structure disposed below the baffle as the mold structure is withdrawn from the furnace chamber 22. The maintaining of a relatively large vertical temperature gradient across the baffle 30 promotes the growth of a fine dendritic structure as molten metal solidifies in the mold structure 12. In addition, the establishment and maintaining of a large vertical temperature gradient promotes the solidification of the molten metal in the mold structure 12 upwardly from the lower end portion 32 of the mold structure to the upper end portion 34 of the mold structure as the mold structure is lowered from the furnace chamber 22.

As the chill plate 24 continues to move downwardly past the position shown in FIG. 4, the upper end of the irregular side portion 48 approaches the baffle 30. Still further downward movement results in the irregular side portion 48 of the mold structure 12 being moved below the baffle 30. As the chill plate 24 and mold structure 12 continue to move downwardly, the upper end or gating portion 34 of the mold structure 12 moves through the circular central opening in the baffle 30.

As the majority of the upper end or gating portion 34 moves through the baffle 30, there is space between a circular inner edge of the annular baffle and the mold structure. Therefore, the magnitude of the temperature gradient across the baffle 30 will decrease. However, by this time, the molten metal in the article mold cavities 42 will have either completely or almost completely solidified. Therefore, the maintaining of a large temperature gradient across the baffle 30 is not crucial to the obtaining of high quality castings.

Continued lowering of the chill plate 24 and mold structure 12 moves the mold structure downwardly to the loading position. When the mold structure 12 is in the loading position, it is disposed a substantial distance beneath the furnace chamber 22. The housing enclosing the furnace 14 can then be opened and the mold structure 12 removed from the chill plate 24.

Baffle

The baffle 30 retards the transfer of heat from the portion of the mold structure 12 disposed above the baffle. The baffle 30 includes an annular support portion 52 (FIG. 5) and a coaxial annular seal portion 54. The support portion 52 is connected with the furnace 14 (FIGS. 1–4) in a coaxial relationship with the cylindrical furnace chamber 22. The connection between the stationary support portion 52 of the baffle 30 and the furnace 14 holds the baffle in place as the mold structure 12 is moved into and out of the furnace chamber 22.

In the embodiment of the invention illustrated in FIGS. 1–4, the support portion 52 of the baffle is clamped between the susceptor wall 16 and a bottom ring 58 of the furnace 14 to hold the baffle 30 in place. However, it is contemplated that the baffle could be connected with the furnace in a different manner if desired. For example, the baffle 30 could be connected with the furnace by a releasable support structure in the manner disclosed in U.S. Pat. No. 4,763,716 issued Aug. 16, 1988 and entitled "Apparatus and Method for Use in Casting Articles".

The seal portion 54 of the baffle 30 extends radially inwardly from the support portion 52. The seal portion 54 engages the irregular side portion 48 of the mold structure 12 during movement of the mold structure into and out of the furnace chamber 22. In addition, the seal portion 54 engages the mold structure 12 while the mold structure is stationary in the raised position in the furnace chamber 22 (FIG. 4).

The seal portion 54 is resiliently flexible to maintain engagement with the irregular side portion 48 of the mold structure 12 during raising and lowering of the mold structure. Thus, projections on the irregular side portion 48 of the mold structure 12 resiliently deflect the seal portion 54 of the baffle 30 as the mold structure moves through the baffle. When a recess in the irregular side portion 48 moves through the baffle 30, the natural resilience of the seal portion 54 causes it to flex toward the mold structure 12 and maintain engagement with the mold structure. It is contemplated that the turbine blades and article mold cavities 42 may be twisted about their longitudinal central axes. When the articles and article molds have such a configuration, the seal portion 54 is resiliently flexed to maintain engagement with the twisted contour of the article molds 14.

Figure 6:
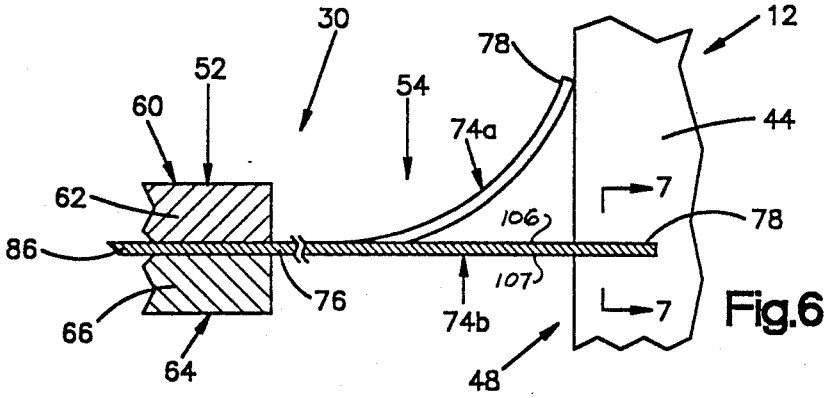
FIG. 6 is a fragmentary sectional view, taken generally along the line 6—6 of FIG. 5, illustrating the manner in which a flexible segment of the baffle is deflected relative to an adjacent segment of the baffle by the irregular side portion of the mold structure.
Figure 5:
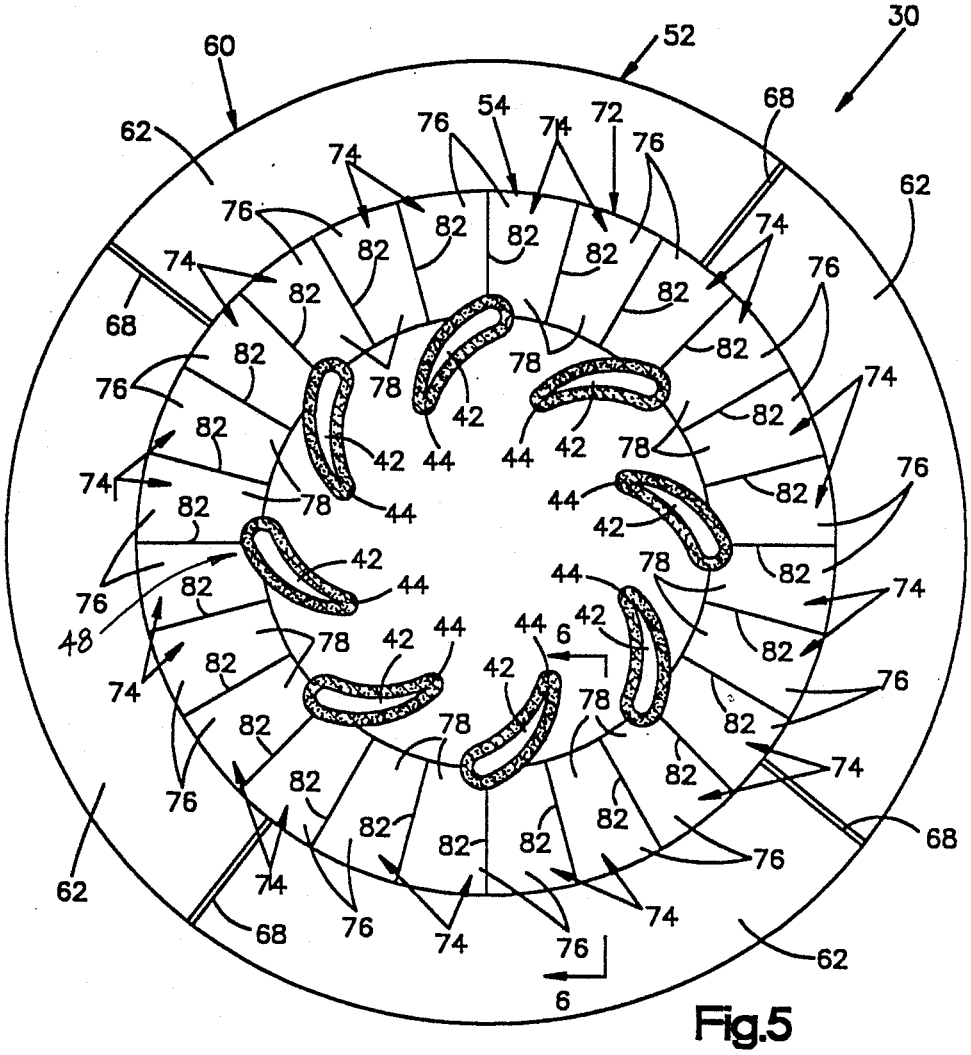
FIG. 5 is a plan view, taken generally along the line 5—5 of FIG. 3, illustrating the relationship between the baffle and a plurality of article molds which partially form an irregular side portion of the mold structure.

The annular support portion 52 of the baffle 30 includes an annular upper layer 60 of support segments 62 (FIGS. 5 and 6) and an annular lower layer 64 (FIG. 6) of support segments 66. The support segments 62 and 66 are separated by radially extending expansion joints 68 (FIG. 5) disposed between the support segments. The expansion joints 68 accommodate expansion and contraction of the support portion 52 of the baffle during heating and cooling of the baffle. The support segments 62 and 66 are formed of graphite. The annular layers 60 and 64 have a combined axial thickness of approximately 0.125 inches.

The flexible seal portion 54 extends from the support portion 52 (FIGS. 5 and 6) and engages the irregular side portion 48 of the mold structure 12. The seal portion 54 of the baffle 30 includes an annular array 72 (FIG. 5) of flexible segments 74. The flexible segments 74 extend from the support portion 52 and are engageable with the mold structure 12.

Each of the flexible segments 74 includes an inner end or base portion 76 and an outer or free end portion 78. The base 76 of each of the flexible segments 74 is fixedly connected with the support portion 52. Each of the flexible segments 74 normally extends straight inwardly from the support portion 52. Thus, each of the flexible segments 74 forms a separate cantilevered beam which, when in an undeflected condition, extends radially from the annular support portion 52 and has flat horizontal upper and lower major side surfaces.

As the mold structure 12 moves into and out of the furnace chamber 22, the flexible segments 74 of the seal portion 54 of the baffle 30 are resiliently flexed (FIGS. 5 and 6) to an extent which varies as a function of the configuration of the irregular side portion 48 of the mold structure 12. Thus, forces are transmitted from the irregular side portion 48 of the mold structure 12 to flex the segments 74 outwardly in the manner indicated schematically by the segment 74*a* in FIG. 6. The natural resiliency of the material forming the flexible segment 74*a* (FIG. 6) causes the segment to flex inwardly toward its original straight configuration to maintain contact with the irregular side portion 48 of the mold structure 12 at a recess or concave portion of the mold structure. During movement of the mold structure 12 into and out of the furnace chamber 22, the resilient segments 74 flex radially inwardly and outwardly, relative to the support portion 52, to maintain engagement with the irregular side portion 48 of the mold structure.

The flexible segments 74 of the seal portion 54 are separated by radially extending slits 82. The slits 82 extend from the support portion 52 to the outer ends of the segments 74. The slits 82 allow each of the segments 74 to be freely flexed relative to adjacent segments. Therefore, force is not transmitted from one segment 74 to another segment when the one segment is flexed. This allows the free end portion 78 of each of the segments 74 to move independently of adjacent segments and as a function of the configuration of the irregular side portion 48 of the mold structure 12.

The seal portion 54 is formed from a single piece of material. This piece of material has an annular base 86 (FIG. 6) which is disposed between the annular upper and lower layers 60 and 64 of the support portion 52 of the baffle. The flexible segments 74 are integrally formed with the base 86 and extend radially inwardly from the base. The segments 74 are separated by the slits 82 which extend from the free ends of the segments to the annular base 86.

Figure 7:
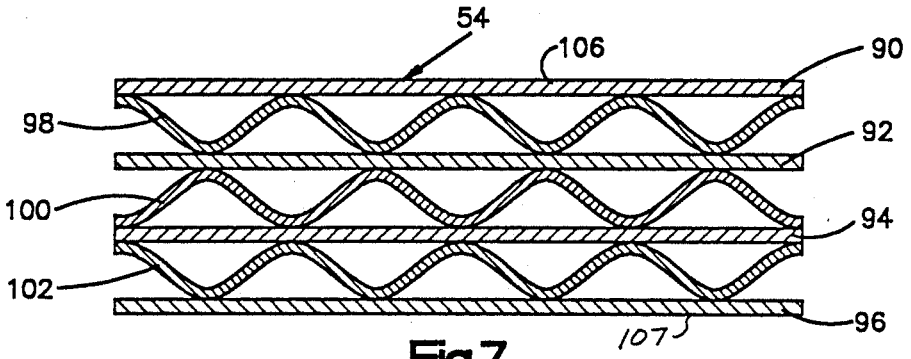
FIG. 7 is a schematic sectional view, taken generally along the line 7—7 of FIG. 6, illustrating the construction of a flexible segment of the baffle.

The seal portion 54 of the baffle 30 is advantageously formed from graphite. In one specific embodiment of the invention, the seal portion 54 had a laminated construction (FIG. 7). Thus, in this specific embodiment of the invention, the seal portion 54 is formed from a plurality of layers of graphite foil. The layers of graphite foil include a plurality of flat layers 90, 92, 94 and 96 (FIG. 7) and a plurality of corrugated layers 98, 100, and 102. The layers 90–102 of graphite foil have an overall thickness, as measured from the upper surface 106 of the upper layer 90 to the lower surface 107 of the lower layer 96 of approximately 0.015 inches. Thus, the 0.125 inch thickness of the support portion 52 is more than five times the thickness of the flexible segments 74.

The graphite foil forming the seal portion 54 is anisotropic and has a coefficient of anisotrophy of approximately 30. The thermal conductivity of the layers 90–102 of foil in a direction parallel to an upper major side surface 106 of the upper foil layer 90 is approximately 1,500 BTU-in./hr. ft.$^{2}$° F. The thermal conductivity of the seal portion 54 in a direction perpendicular to the flat upper side surface 106 is approximately 50 BTU-in./hr. ft.$^{2}$° F. This enables the seal portion 54 to conduct heat radially relative to the mold structure 12 along flow paths extending along the surfaces 106 and 107 to eliminate hot spots while enabling the seal portion to retard the transfer of heat between opposite sides of the baffle 30 in a direction transversely to the surfaces 106 and 107.

During a casting operation, relatively high temperatures, approximately 3,000° F., are present in the evacuated furnace chamber 22. Therefore, radiation is a major form of heat transfer. To retard the transfer of heat from the furnace chamber 22 to the chill plate 24, the major side surfaces of each of the layers 90–102 (FIG. 7) of the seal portion 54 have a relatively high reflectivity. Thus, each of the major side surfaces of the layers 90–102 has a spectral emissivity of less than 0.55, usually about 0.50, at a temperature of 3,000° F.

Although it is contemplated that the seal portion 54 could be constructed of many different materials, in one specific preferred embodiment of the invention, the seal portion 54 was formed of "Graphfoil" (trademark) obtained from Union Carbide Corporation, Carbon Products Division, having a place of business at 1200 South Riverside Plaza, Chicago, Ill. 60606. Of course, if desired, other known materials could be utilized to form the seal portion 54. In addition, the seal portion 54 could have a construction different than the laminated construction illustrated in FIG. 7.

When the mold structure 12 is moved into and out of the furnace chamber 22, the seal portion 54 is resiliently flexed in and out to accommodate the irregular configuration of the mold structure while maintaining engagement of the seal portion with the mold structure. Thus, as the chill plate 24 and mold structure 12 are raised upwardly into the furnace chamber 22 (FIG. 1), the segments 74 (FIG. 5) of the seal portion 54 are all flexed upwardly by engagement of the circular upper or gating portion 34 of the mold structure 12 with the seal portion 54. At this time, the end portions 78 of all the flexible segments 74 point upwardly, in the manner illustrated schematically the segment 74*a* in FIG. 6.

As the mold structure 12 continues to move upwardly, the seal portion 54 engages the article molds 44. As is perhaps best seen in FIG. 5, the article molds 44 are spaced apart relative to each other. Therefore, when the mold structure 12 moves upwardly so that the article molds 44 engage the seal portion 54, some of the flexible segments 74 are released. The natural resilience of the released segments 74 causes them to flex back to their original straight configuration, as indicated by the flexible segment 74*b* in FIG. 6. Other flexible segments 74 engage the article molds 44 and remain flexed to a greater or lesser extent, as indicated by the flexible segment 74*a* of FIG. 6.

When the mold structure 12 reaches the fully raised position of FIG. 2, the seal portion 54 of the baffle 30 is deflected upwardly by the lower portion 32 of the mold structure. At this time, each of the flexible segments 74 is either in engagement with the lower end portion of an article mold 44 or is closely adjacent to a flat circular base disc 110 at the lower end portion 32 of the mold structure 12. Therefore, there is no open space between irregular outer side portion 48 of the mold structure 12 and the baffle 30 through which heat can be radiated from the furnace chamber 22. This results in the heat loss from the furnace chamber 22 to the chill plate 24 being minimized during preheating of the mold structure 12.

After preheating the mold structure 12 and pouring of molten metal into the mold structure, the chill plate 24 and mold structure are lowered. As the mold structure 12 is lowered, the flexible segments 74 of the seal portion 54 of the baffle 30 flex to maintain engagement with the irregular side portion 48 of the mold structure 12. The article molds 44 press the segments 74 radially outwardly to deflect them in the manner shown schematically for the segment 74*a* in FIG. 6. Segments 74 of the seal portion 54 at spaces between the article molds 44 are not deflected by the article molds. Therefore, the natural resilience of these segments causes them to assume their straight initial or unrestrained condition, illustrated by the segment 74*b* of FIG. 6.

As the mold structure 12 continues to be withdrawn from the furnace, the seal portion 54 flexes to maintain engagement with the irregular side portion 48 of the mold structure. Thus, as the configuration or contour of the irregular side portion 48 of the mold structure 12 changes along the length of the article molds 44, the segments 74 flex in and out to maintain engagement with the irregular side portion 48 of the article molds. The segments are resiliently flexed outwardly by the force transmitted from the article molds 44 to the end portions 78 of the segments 74. The segments 74 are flexed inwardly by their own natural resilience to either maintain contact with an inwardly curving contour of the irregular side portion 48 of the mold structure 12 or to assume their initial flat condition, illustrated by the segment 74*b* of FIG. 6.

As the mold structure 12 is lowered, the segments 74 of the seal portion 54 tend to remain deflected upwardly as shown in FIGS. 2 and 3. As the mold structure 12 moves downwardly, the upturned segments 74 of the seal portion 54 of the baffle 30 wipe along the surfaces of the article molds 44. If an outer end portion 78 of an upturned segment 74 encounters a discontinuity or proturberance on an article mold 44, the end portion 78 may catch on the discontinuity or proturberance and be pulled downwardly with the mold structure 12. This will result in the upwardly deflected segment 78 being resiliently flexed to an downwardly extending orientation (FIG. 4). Thus, as the article molds 44 move downwardly through the baffle 30, some of the flexible segments 74 could be pointed upwardly, while other flexible segments are pointed downwardly.

When the mold structure 12 has been withdrawn from the furnace chamber 22 for a sufficient distance, outwardly projecting shoulders 114 (FIG. 3) at the upper end portion of the article molds 44 to engage the end portions 78 of the upturned flexible segment 74. The upturned flexible segments 74 are then deflected to a downward orientation (FIG. 4). Thus, as one of the shoulders 114 engages the outer end portion 78 of an upwardly turned flexible segment 74, the shoulder causes the segment to buckle or be deflected downwardly. As the mold structure 12 continues to be withdrawn from the furnace chamber 22, the downwardly deflected segments 74 of the seal portion 54 maintain engagement with the irregular side portion 48 of the mold structure 12.

When the mold structure 12 has been moved downward through a sufficient distance, the upper end portion 34 of the mold structure moves out of engagement with the flexible segments 74. This occurs as the irregular side portion 48 moves below the baffle 30. The flexible segments 74 then return to their initial straight condition under the influence of their own natural resilience.

Baffle—Second Embodiment

In the embodiment of the invention in FIGS. 1–7, the baffle 30 cooperates with the outside of the mold structure 12. Thus, the baffle 30 engages the irregular outer side portion 48 of the mold structure. This enables the baffle 30 to retard heat flow between the inner wall of the furnace 14 and the outside of the mold structure 12.

It is contemplated that it may be desired to have a baffle on the inside of the annular array of article molds 44 to block the transmission of heat through the open central portion of the mold structure 12. Therefore, an inner baffle is provided in the embodiment of the invention illustrated in FIG. 8. The inner baffle retards the transfer of heat through the open central portion of the mold structure. Since the embodiment of the invention illustrated in FIG. 8 is generally similar to the embodiment of the invention illustrated in FIGS. 1–7, similar numerals will be utilized to designate similar components, the prefix numeral "2" being added in FIG. 8 to the numerals of FIGS. 1–7 to avoid confusion.

Figure 8:
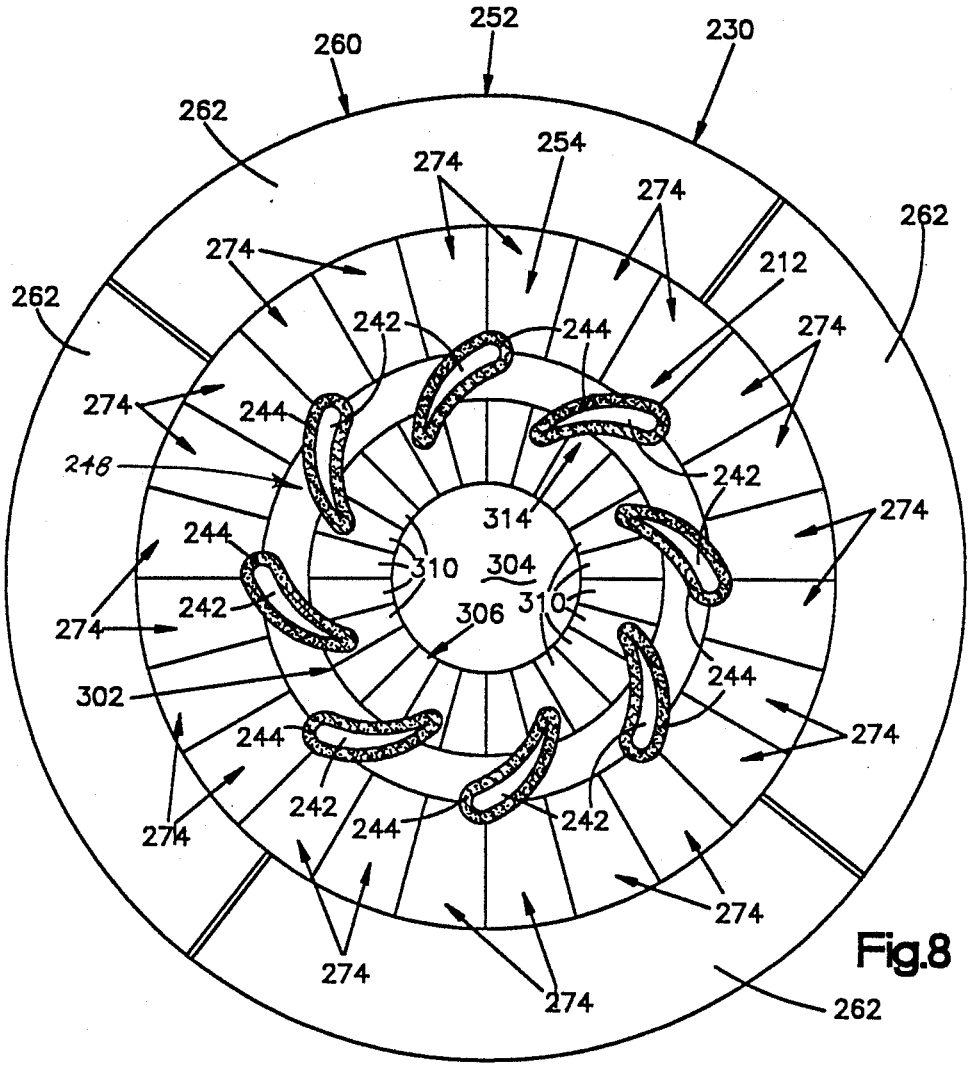
FIG. 8 is a sectional view, generally similar to FIG. 5, of a second embodiment of the invention in which inner and outer baffles are used in association with a mold structure.

In the embodiment of the invention illustrated in FIG. 8, an annular outer baffle 230 extends around the outside of a mold structure 212. The annular outer baffle 230 includes an annular support portion 252 and a flexible annular seal portion 254. The support portion 252 includes an annular upper layer 260 formed by an annular array of segments 262 and a corresponding annular lower layer of segments. The upper and lower layer of the support portion 252 grip opposite sides of the flexible seal portion 254 to connect the seal portion with a furnace.

The seal portion 254 includes a plurality of radially inwardly extending flexible segments 274. The flexible segments 274 engage an irregular outer side portion 248 of the mold structure 212 during movement of the mold structure into and out of a furnace chamber. The flexible segments 274 also engage the irregular outer side portion 248 of the mold structure 212 when the mold structure is stationary in the raised position in the furnace chamber during preheating of the mold structure.

In accordance with a feature of this embodiment of the invention, an inner baffle 302 is provided in an open central portion of the mold structure 212. The inner baffle 302 includes a circular support portion 304 and a seal portion 306. The support portion 304 of the inner baffle 302 is disposed on the same level as the support portion 252 of the outer baffle 230. Similarly, the seal portion 306 of the inner baffle 302 is disposed on the same level as the seal portion 254 of the outer baffle 230. Thus, the outer baffle 230 circumscribes the inner baffle 302 and is disposed on the same level as the inner baffle.

The annular seal portion 306 of the circular inner baffle 302 includes a plurality of flexible segments 310 which extend radially outwardly from the support portion 304. The flexible segments 310 engage an irregular inner side portion 314 of the mold structure 212. A plurality of radially extending slits separate the flexible segments 310 from each other.

When the mold structure 212 is moved into a furnace chamber, the normally flat flexible segments 310 are flexed upwardly by and remain in engagement with the irregular inner side portion 314 of the mold structure 212. As the mold structure 212 is lowered from the furnace chamber, the flexible segments 310 are resiliently flexed radially inwardly by force applied against the end portions of the segments by the irregular inner side portion 314 of the mold structure 312. In addition, as the mold structure 212 is withdrawn from the furnace chamber, the natural resilience of the flexible segments 310 causes them to flex radially outwardly to remain in engagement with outwardly contoured portions of the irregular inner side portion 314 of the mold structure 212.

During withdrawal of the mold structure 212 from a furnace chamber, the resilient seal portion 254 of the outer baffle 230 and the resilient seal portion 306 of the inner baffle 302 are maintained in engagement with the outer and inner irregular side portions 248 and 314 of the mold structure. Thus, the resilient segments 310 of the inner baffle 302 are maintained in engagement with the irregular inner side portion 314 of the mold structure 212 while the mold structure is lowered through a distance which is at least substantially as great as the vertical height of the article mold cavities 242. Due to interference between the support portion 304 of the inner baffle 302 and the gating or upper end portion of some mold structures, the mold structure may be movable downwardly relative to the inner baffle 302 through a distance which is slightly less than the vertical height of the article mold cavities 242. However, in the embodiment of the invention illustrated in FIG. 8, the gating portion of the mold structure 212 is constructed so as to allow the inner baffle 302 to remain in engagement with the irregular inner side portion 314 until the upper ends of the article mold cavities 242 have moved below the inner baffle 302.

The circular support portion 304 of the inner baffle 302 is formed of graphite. The flexible annular seal portion 306 of the inner baffle 302 is formed of graphite foil. The graphite foil of the seal portion 306 has the same laminated construction shown in FIG. 7. Although the outer baffle 230 and inner baffle 302 could be supported in many different ways, it is contemplated that the baffles will be supported by a support structure which extends through the chill plate in the manner disclosed in U.S. Pat. No. 4,763,716 issued Aug. 16, 1988 and entitled "Apparatus and Method for Use in Casting Articles".

Conclusion

In view of the foregoing description, it is apparent that the present invention is directed to a method and apparatus 10 which is used during the casting of molten metal in a mold structure 12 having an irregular side portion 48. The apparatus 10 includes a movable chill plate 24 which supports a mold structure 12 in a furnace chamber 22. A baffle 30 is provided to retard the transfer of heat from the mold structure 12 when the mold structure is in the furnace chamber 22 and during withdrawal of the mold structure 12 from the furnace chamber 22.

The baffle 30 includes a circular support portion 52 and a plurality of flexible segments 74 which extend from the support portion. End portions 78 of at least some of the flexible segments 74 are engageable with and movable relative to the irregular side portion 48 of the mold structure 12 during relative movement between the baffle 30 and the mold structure. The flexible characteristics of the segments 74 enable them to remain in engagement with the irregular side portion 48 of the mold structure 12 until the irregular side portion 48 moves below the baffle 30 as the mold structure 12 is lowered from the furnace chamber 22.

In the embodiment of the invention illustrated in FIG. 8, the apparatus includes a movable chill plate which supports a mold structure 212 in a furnace chamber. An inner baffle 302 is provided to retard the transfer of heat from the mold structure 212 when the mold structure is in the furnace chamber and during withdrawal of the mold structure from the furnace chamber.

The baffle 302 includes a circular support portion 304 and a plurality of flexible segments 310 which extend from the support portion. End portions of at least some of the flexible segments 310 are engageable with and movable relative to the irregular inner side portion 314 of the mold structure 212 during relative movement between the baffle 302 and the mold structure. The flexible characteristics of the segments 310 enable them to remain in engagement with the irregular side portion 314 of the mold structure 212 until the irregular side portion moves below the baffle 302 as the mold structure is lowered from the furnace chamber.

Having described specific preferred embodiments of the invention, the following is claimed:

1. An apparatus for use during casting of molten metal in a mold structure having an irregular side portion, said apparatus comprising furnace means for transmitting heat to the mold structure, movable chill plate means for receiving heat during casting and for supporting the mold structure, baffle means for retarding the transfer of heat from the mold structure, and means for moving said chill plate means and mold structure relative to said furnace means between a raised position in which the mold structure is disposed in said furnace means and a lowered position in which the mold structure is at least partially outside of said furnace means, said baffle means being disposed adjacent to said chill plate means and a lower end portion of the mold structure when said chill plate means is in the raised position, said baffle means being disposed adjacent to an upper end portion of the mold structure when said chill plate means is in the lowered position, said baffle means including a circular support portion and a plurality of flexible segments which extend from said support portion, each of said segments having an end portion which is spaced from said support portion of said baffle means and which is separate from the end portions of adjacent segments, said end portions of at least some of said segments being engageable with the irregular side portion of the mold structure to retard the transfer of heat through said baffle means, said segments being movable relative to the irregular side portion of the mold structure and relative to adjacent segments during relative movement between the mold structure and said baffle means to enable said end portions of at least some of said segments to engage the irregular side portion of the mold structure during relative movement between said baffle means and the mold structure.

2. An apparatus as set forth in claim 1 wherein said flexible segments are disposed in an annular array and said circular support portion of said baffle means circumscribes said annular array of flexible segments, said flexible segments extending generally radially inwardly from said support portion of said baffle means.

3. An apparatus as set forth in claim 1 wherein said flexible segments are disposed in an annular array and said circular support portion of said baffle means is circumscribed by said annular array of flexible segments, said flexible segments extending generally radially outwardly from said support portion of said baffle means.

4. An apparatus as set forth in claim 1 wherein said flexible segments of said baffle means are formed of graphite foil.

5. An apparatus as set forth in claim 1 wherein said furnace means includes means for engaging said support portion of said baffle means and holding said support portion of said baffle means against movement relative to said furnace means during movement of said chill plate means and mold structure between the raised and lowered positions.

6. An apparatus as set forth in claim 1 wherein said support portion of said baffle means has a thickness as measured in a direction parallel to a central axis of said support portion which is at least five times as great as the thickness of said segments of said baffle means as measured in a direction parallel to the central axis of said support portion prior to deflecting of said segments.

7. An apparatus as set forth in claim 1 wherein said flexible segments are disposed in an annular array and said segments are separated from each other by a plurality of slits which extend in a generally radial direction relative to said support portion of said baffle means.

8. An apparatus as set forth in claim 1 wherein said flexible segments of said baffle means have a laminated construction with at least one corrugated sheet of graphite disposed between flat sheets of graphite.

9. An apparatus as set forth in claim 1 wherein upper side surfaces of said segments of said baffle means have an emissivity of less than 0.55 at a temperature of 3,000° F.

10. An apparatus as set forth in claim 1 wherein said support portion includes a plurality of expansion joints to accommodate thermal expansion of said support portion.

11. A method of casting using a mold structure having an irregular side portion which extends between upper and lower end portions of the mold structure, said method comprising the steps of supporting the mold structure on a chill plate, flowing molten metal into an article mold cavity in the mold structure, retarding the transfer of heat from the mold structure with a baffle disposed adjacent to the lower end portion of the mold structure, said baffle including a circular support portion and a plurality of flexible segments extending from said support portion, thereafter, lowering the chill plate and mold structure relative to the baffle through a distance which is greater than the vertical height of the article mold cavity, engaging the irregular side portion of the mold structure with the flexible segments of the baffle, and maintaining the flexible segments of the baffle in engagement with the irregular side portion of the mold structure while the mold structure is lowered through a distance which is at least substantially as great as the vertical height of the article mold cavity.

12. A method as set forth in claim 11 wherein said step of maintaining the baffle in engagement with the irregular side portion of the mold structure includes maintaining flexible segments of the baffle in engagement with the irregular side portion of the mold structure by resiliently flexing the segments of the baffle toward and away from a central axis of the baffle as the mold structure is lowered.

13. A method as set forth in claim 12 wherein said step of flexing the segments of the baffle toward and away from the central axis of the baffle as the mold structure is lowered includes flexing the segments away from the central axis of the baffle under the influence of force applied against end portions of the segments by the irregular side portion of the mold structure.

14. A method as set forth in claim 13 wherein said step of flexing the segments of the baffle toward and away from the central axis of the baffle as the mold structure is lowered further includes flexing the segments toward the central axis of the baffle under the influence of the natural resilience of the material forming the flexible segments.

15. A method as set forth in claim 12 wherein said step of flexing the segments of the baffle toward and away from the central axis of the baffle as the mold structure is lowered includes flexing the segments toward the central axis of the baffle under the influence of force applied against end portions of the segments by the irregular side portion of the mold structure.

16. A method as set forth in claim 15 wherein said step of flexing the segments of the baffle toward and away from the central axis of the baffle as the mold structure is lowered further includes flexing the segments away from the central axis of the baffle under the influence of the natural resilience of the material forming the flexible segments.

17. A method as set forth in claim 12 wherein said step of flexing the segments of the baffle toward and away from a cental axis of the baffle as the mold structure is lowered includes flexing at least one of the segments between an orientation in which an end portion of the one segment points upwardly and an orientation in which the end portion of the one segment points downwardly.

18. A method as set forth in claim 12 wherein said step of resiliently flexing the segments of the baffle includes resiliently flexing one of the segments relative to an adjacent segment without transmitting force from the one segment to the adjacent segment.

19. A method as set forth in claim 11 further including the step of transmitting heat along flow paths extending along major side surfaces of the baffle at a greater rate than along flow paths extending transversely to major side surfaces of the baffle.

* * * * *